US006357982B1

(12) United States Patent
Jowitt et al.

(10) Patent No.: US 6,357,982 B1
(45) Date of Patent: Mar. 19, 2002

(54) APPARATUS FOR MAKING CAN BODIES

(75) Inventors: Frederick William Jowitt, Bingley; Ian Kenneth Scholey, Wakefield; David William Smith, Keighley, all of (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/423,176

(22) PCT Filed: Apr. 6, 1998

(86) PCT No.: PCT/GB98/01013

§ 371 Date: Nov. 3, 1999

§ 102(e) Date: Nov. 3, 1999

(87) PCT Pub. No.: WO98/57763

PCT Pub. Date: Dec. 23, 1998

(30) Foreign Application Priority Data

Jun. 17, 1997 (GB) ..... 9712539

(51) Int. Cl.[7] ..... B21D 51/44
(52) U.S. Cl. ..... 413/69; 413/78; 72/361
(58) Field of Search ..... 413/69, 76; 72/349, 72/361, 94

(56) References Cited

U.S. PATENT DOCUMENTS

| | | | | | |
|---|---|---|---|---|---|
| 2,919,801 | A | * | 1/1960 | Pechy | |
| 3,490,404 | A | * | 1/1970 | Vanderlaan et al. | 72/94 |
| 3,802,364 | A | * | 4/1974 | Paramonoff | 72/361 |
| 3,822,576 | A | * | 7/1974 | Hardt | 72/361 |
| 3,889,509 | A | * | 6/1975 | Miller et al. | 72/349 |
| 3,960,099 | A | * | 6/1976 | Dobias et al. | 413/69 |
| 4,061,012 | A | * | 12/1977 | Wessman | 72/361 |
| 4,164,860 | A | * | 8/1979 | Kaminskas | 72/349 |
| 5,566,567 | A | * | 10/1996 | Main | 72/361 |
| 5,617,755 | A | * | 4/1997 | Cheers et al. | 72/349 |

* cited by examiner

*Primary Examiner*—Peter Vo
*Assistant Examiner*—Louis Huynh
(74) *Attorney, Agent, or Firm*—Diller, Ramik & Wight

(57) ABSTRACT

Apparatus for a making can bodies comprises a reciprocating punch and a rotary turret (10) mounted for rotation about a horizontal axis parallel to the axis of the punch. A plurality of flexible finger sets (13) spaced circumferentially around the turret and extending generally radially from the turret are adapted to pick up, support and convey can bodies (16) stripped from the punch as the turret rotates. The turret is driven in rotation at a cyclically varying angular velocity such that the angularly velocity of finger set (13) is less at the moment when it engages a can body stripped from the punch than at other times.

16 Claims, 7 Drawing Sheets

APPARATUS FOR MAKING CAN BODIES

BACKGROUND OF THE INVENTION

The invention relates to apparatus for making can bodies.

In conventional apparatus for making can bodies, can bodies stripped from the punch are picked up on an endless chain conveyor which carries spaced sets of flexible fingers. The conveyor is driven at a constant speed in timed relation to the punch and delivers the can bodies to a gravity conveyor for delivery to a trimmer for trimming the top edge of the can body.

The invention provides an improvement in such apparatus in which can bodies stripped from the punch, after the punch has passed through a die and engaged a tool for forming a dome in the bottom wall of the can body, are picked up, supported and conveyed away from the punch on a rotary turret which is driven in continuous rotation at a cyclically varying angular velocity.

SUMMARY OF THE INVENTION

According to the present invention, there is provided apparatus for making can bodies comprising: a punch mounted for reciprocation on the apparatus; a rotary turret mounted on the apparatus for rotation about a horizontal axis parallel to the axis of the punch; a plurality of conveying elements spaced circumferentially around the turret and extending generally radially from the turret and adapted to pick up, support and convey can bodies stripped from the punch as the turret rotates; and drive means mounted on the apparatus for driving the turret in continuous rotation at a cyclically varying angular velocity such that the angular velocity of a flexible element is less at the moment when it engages a can body stripped from the punch than at other times.

The provision of a rotary turret provides several advantages over a conventional chain conveyor. Firstly, a rotary turret is smaller, simpler and has less components. It also enables more precision to be applied in the control of its drive. The conveyor must operate in a wet area of the apparatus where a cooling and lubricating liquid is present and the maintenance of chain conveyors in such an environment has obvious disadvantages. The drive chains to a turret conveyor can be located in dry areas of the apparatus.

The provision of a cyclically varying drive to the turret enables the speed of the conveying elements on the turret to be controlled so that they are moving more slowly at the moment when they first engage the can bodies than at other times. The varying speed of the elements also allows the "window" of time during which the punch must pass into and out of the space between adjacent elements, to be increased. The relatively slow movement of the conveying elements at the moment of impact with the can bodies enables the overall speed of the apparatus to be increased. With apparatus in accordance with the invention a variation of ±25% has been achieved in the speed of the conveying elements. This has enabled the overall apparatus speed to be increased from 400 can bodies/minute to 500 can bodies/minute without causing damage to the can bodies from impact with the conveying elements.

An embodiment of the invention is described below with reference to the accompanying drawings in which:

DESCRIPTION OF THE PREFERRED EMBODIMENTS

Figure 1:
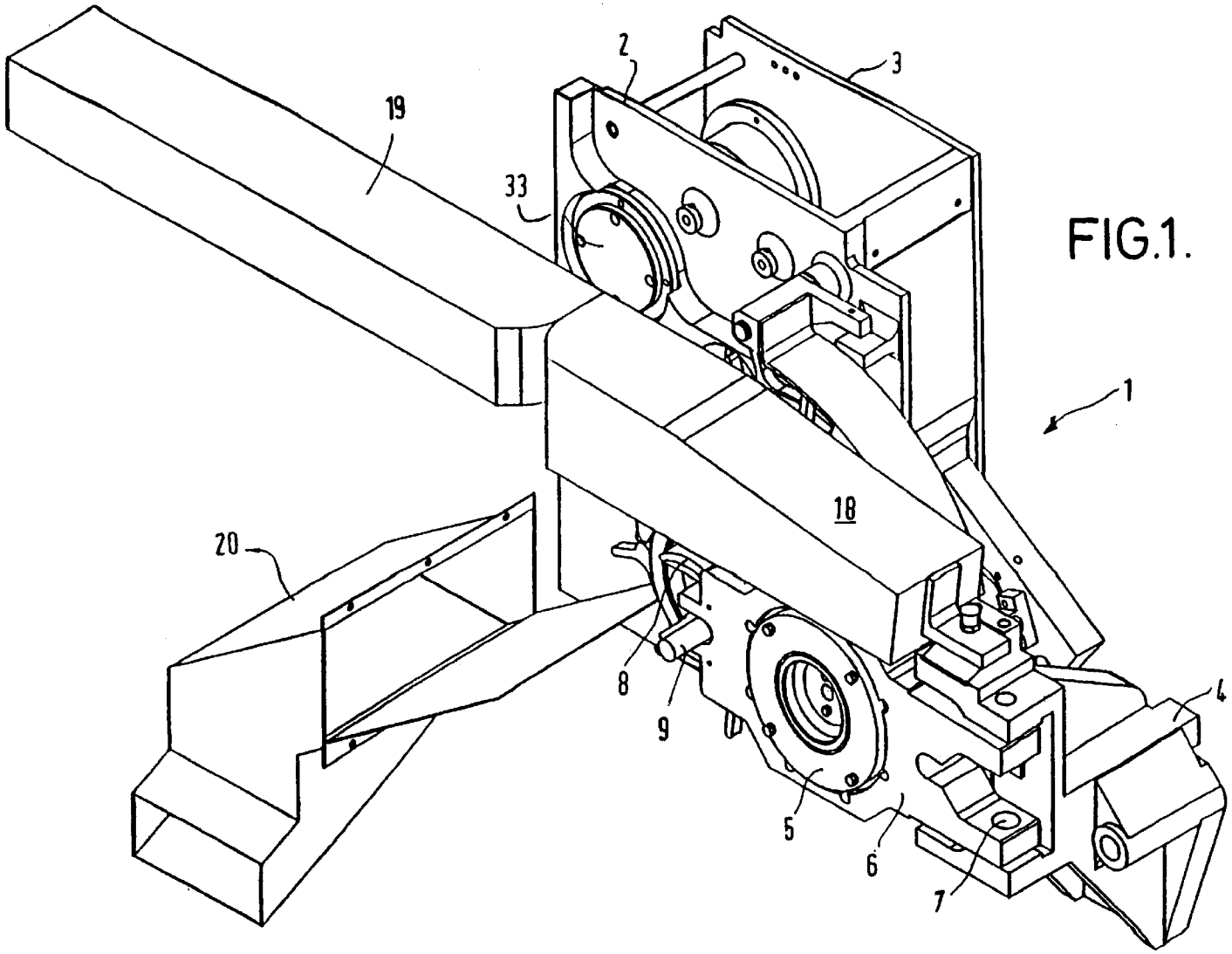
FIG. 1 is a perspective view of the apparatus.
Figure 2:
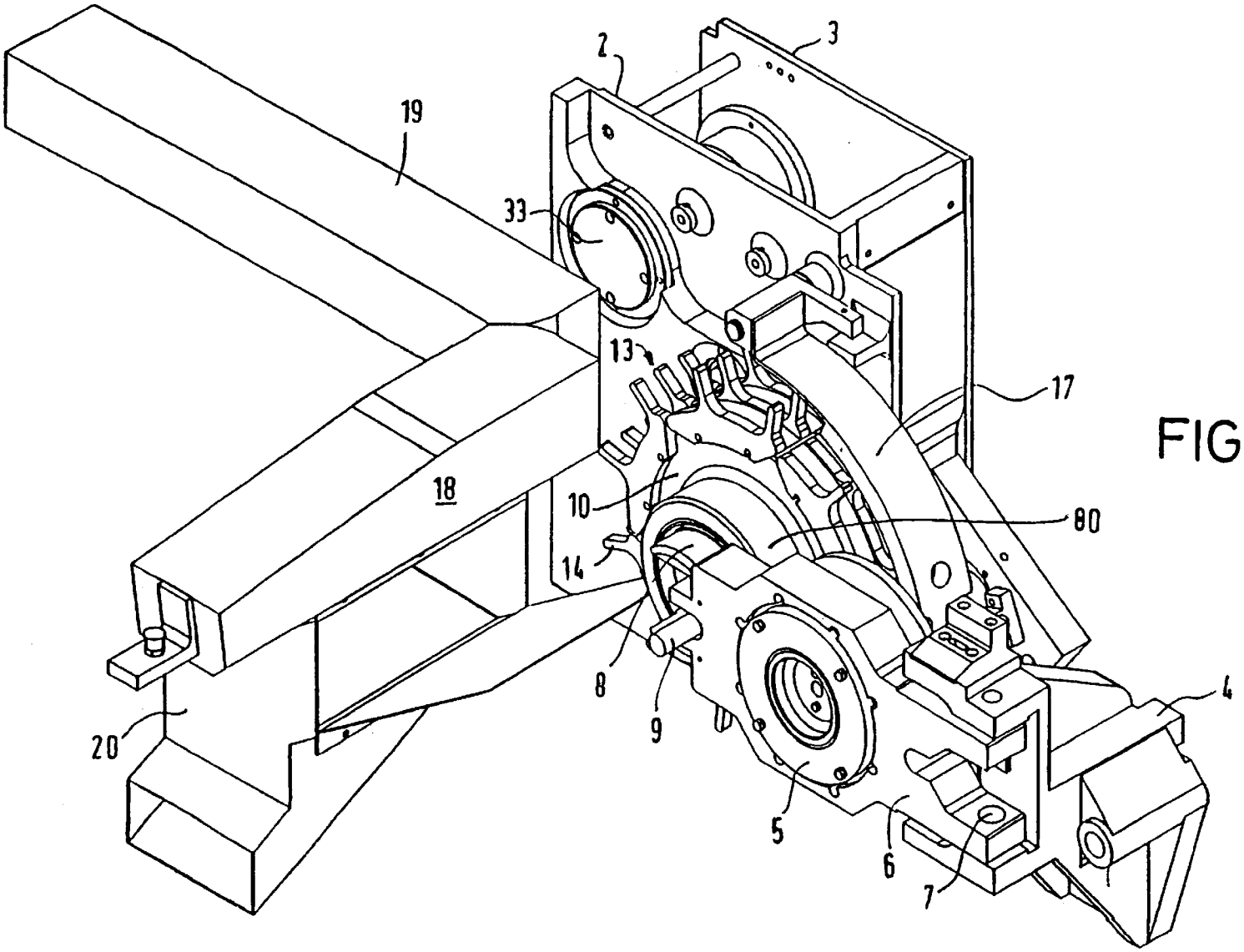
FIG. 2 is a view similar to FIG. 1 with a vacuum conveyor pivoted into an inoperative position.
Figure 6:
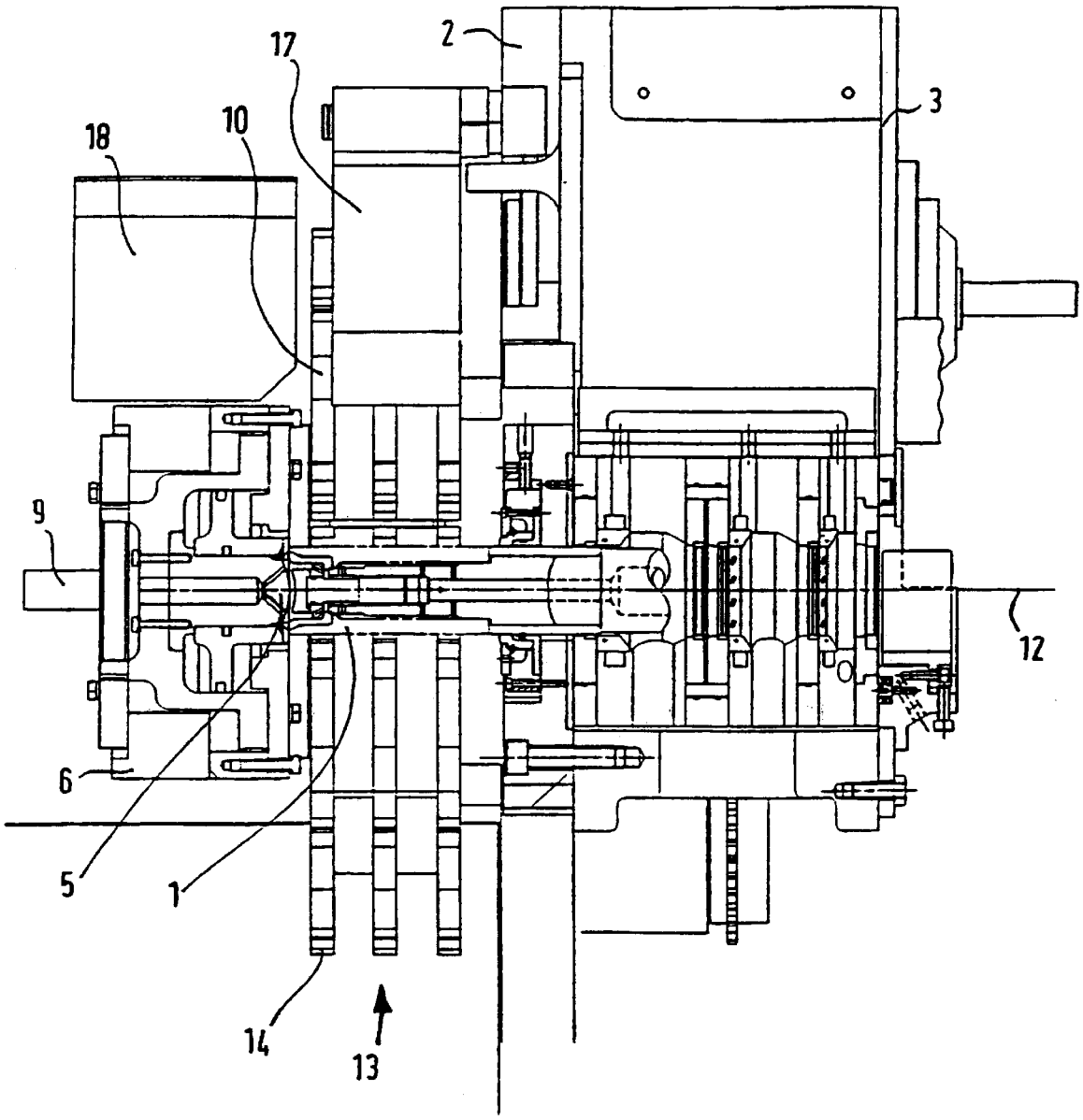
FIG. 6 is a vertical cross-section of the apparatus taken on the axis of the punch.

Referring to FIGS. 1, 2 and 6, the main components of the apparatus can be seen. The apparatus has a frame of which components 2, 3 and 4 are shown in the Figures; frame component 2 being the discharge support bracket.

A punch 1, which can be seen in FIG. 6, is mounted horizontally on the frame to reciprocate on its axis. The punch passes through a die in conventional manner. After passing through the die and at the end of its stroke, the punch engages a tool 5 for forming a dome in the bottom wall of the can body, also in conventional manner. The doming tool 5 is mounted in a support door 6 which is pivotally mounted on frame component 4 at mounting point 7. The door 6 can be pivoted about the mounting point to an inoperative position for maintenance but in its operative position shown in the figures, its end opposite the mounting point 7 is located between a pair of part cylindrical door locater blocks 8 and held in position by means of a bolt 9. This arrangement is again conventional.

Figure 3:
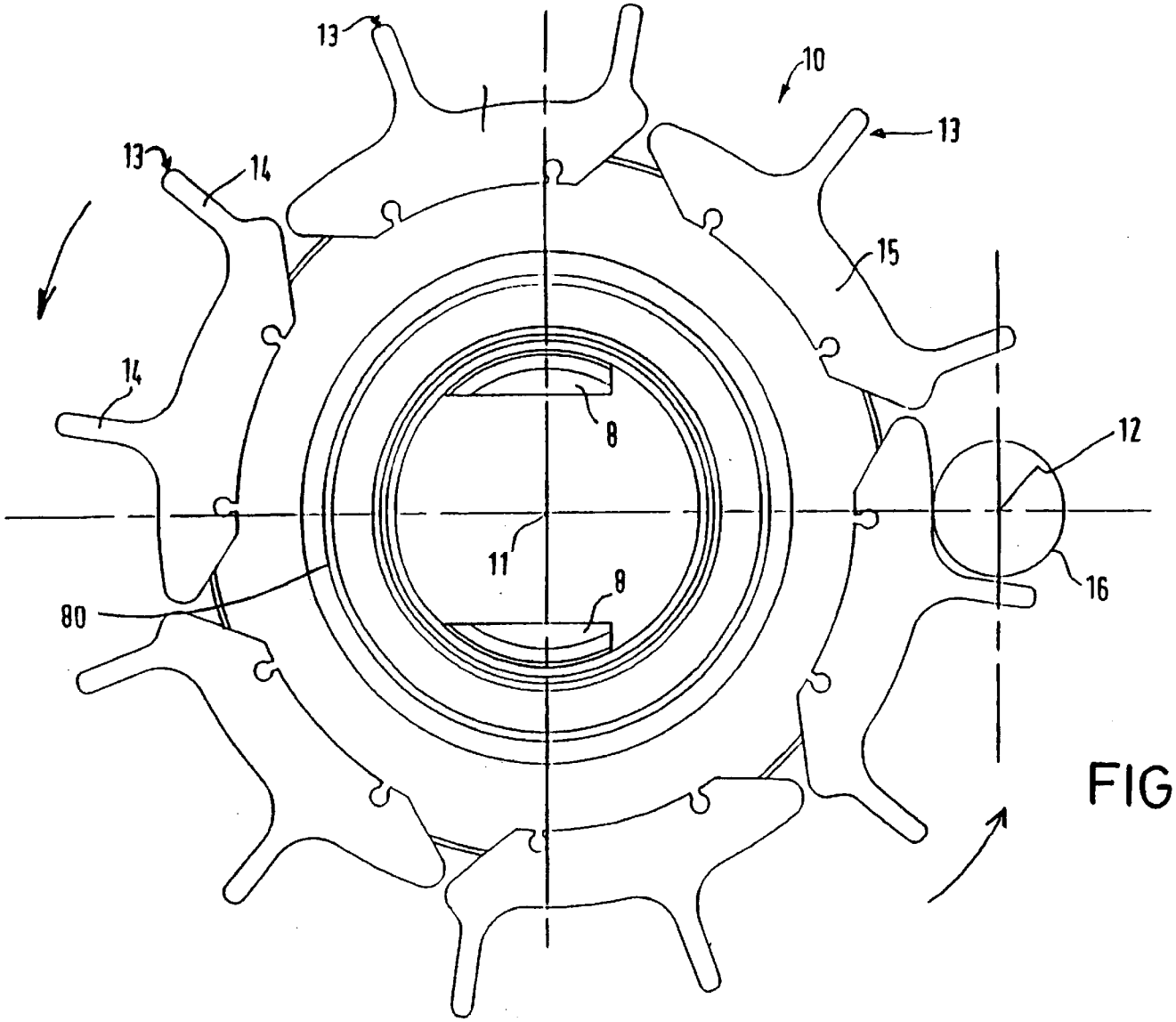
FIG. 3 is a view of the turret.

A rotary turret conveyor 10 is mounted on the apparatus about a horizontal axis which is parallel to and at the same vertical height as the axis of the punch. The turret is mounted on a cylindrical turret bearing arm 80 which is formed with the door locater blocks on the discharge support bracket 2. Thus the turret is effectively mounted around the support for the door 6. The axis 11 of the turret and the axis 12 of the punch are indicted on FIG. 3. The turret is formed around its circumferential periphery with a plurality (twelve in this case) of conveying elements in the form of finger sets 13 which extend generally radially. Each finger set consists of three flexible fingers 14 which are circumferentially aligned but axially spaced on the turret. The fingers are formed from rubber and, as can be seen in FIGS. 2 and 3, are formed in pairs on a block 15 such that each finger is formed integrally with a finger from an adjacent finger set.

The turret is located such that the fingers at the three o'clock position extend into the space between the die and the doming tool. When the punch engages the doming tool, it is located in the space between two adjacent finger sets on the turret. As the punch withdraws from the doming tool, the can body 16 which has just been formed is stripped from the punch in conventional manner and is picked up, supported and conveyed away from the punch by a finger set 13 of the turret. An arcuate brush 17 is mounted over the turret between the three o'clock and twelve o'clock positions to hold the can bodies in place against the finger sets of the turret as they are carried away from the punch on the rotating turret.

A two-part vacuum conveyor 18, 19 is mounted on the apparatus adjacent to the turret to receive can bodies carried thereto by the turret. The vacuum conveyor is of known type and consists of a plastic slatted belt with holes therethrough for connection to a source of vacuum. The first part 18 of the vacuum conveyor is pivotally mounted on the apparatus and can be pivoted into an inoperative position, as shown in FIG. 2, in which it affords access to the turret for maintenance. The vacuum conveyor part 18 picks up can bodies from the turret and delivers them to a second part 19 which carried them towards a trimmer (not shown). Any can bodies which have a malformed bottom wall will not be successfully picked up by the vacuum conveyor 18,19 and will drop from the turret into a receptacle 20 mounted adjacent the turret. A magnetic conveyor could be employed in place of the vacuum conveyor.

Figure 4:
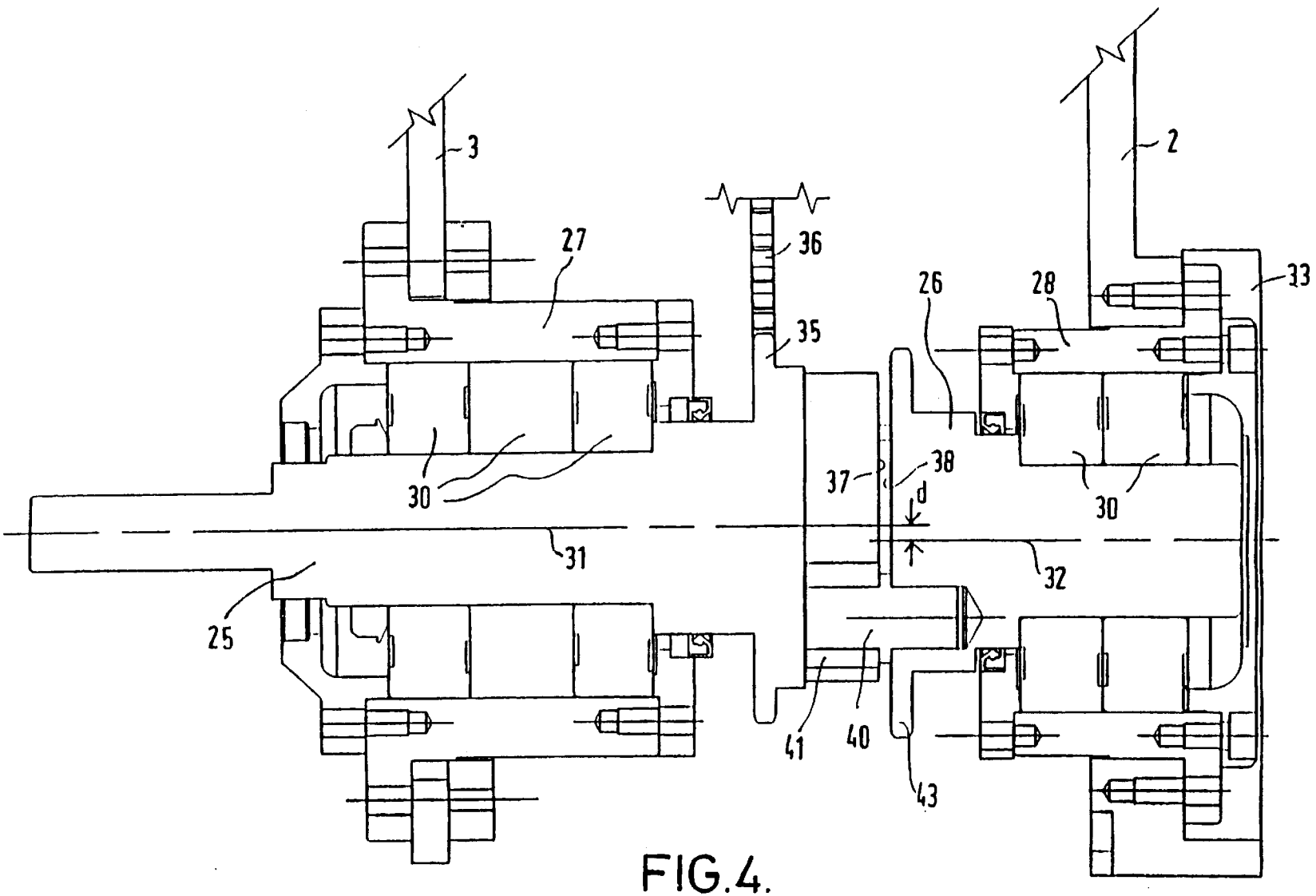
FIG. 4 is a horizontal cross-sectional view through part of the drive means for the turret.
Figure 5:
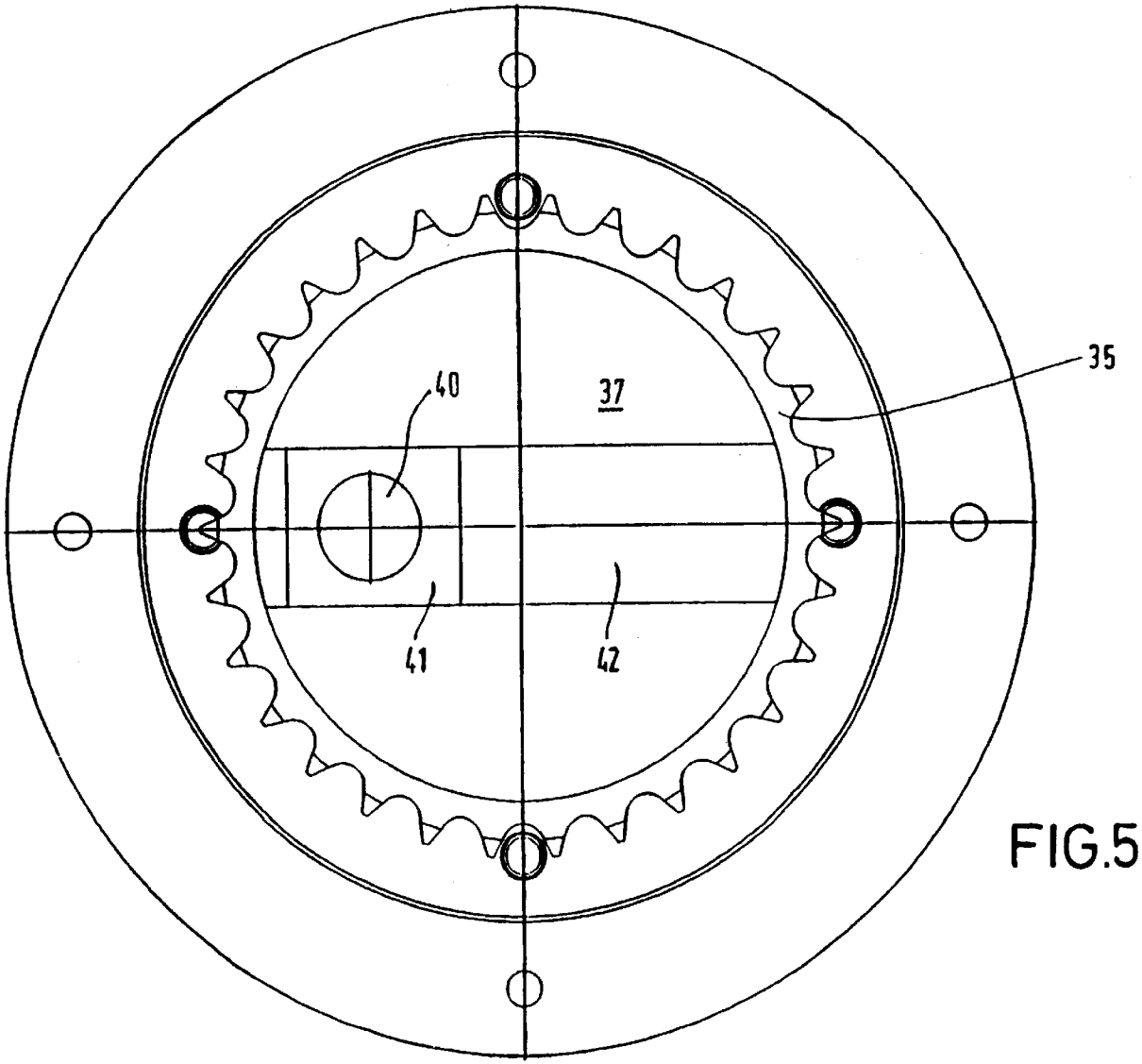
FIG. 5 is an end view of part of the drive means for the turret.

The drive means for the turret will now be described with particular reference to FIGS. 4 and 5. A mechanical system for driving the turret in rotation at a cyclically varying angular velocity is provided and includes an input shaft 25 and an output shaft 26. Shafts 25 and 26 are supported in housings 27 and 28 mounted on the frame components 2 and 3, and rotate in bearings 30 about horizontal axes 31 and 32. The end cap 33 of housing 28 can also be seen in FIGS. 1 and 2.

The input shaft 25 is driven through a sprocket 35 from the main machine drive by a chain 36. The shaft 25 is driven at a constant angular velocity in timed relation with the punch and rotates once during each cycle of the punch. The axes 31 and 32 of the shafts 25 and 26 are parallel to one another but spaced by a distance d. The shafts 25 and 26 are mounted with their end faces 37 and 38 opposing one another. A pin 40 is mounted in the end face 38 of the output shaft 26 and extends axially therefrom to be rotatably received in a bushing 41 which is slidably mounted in a diametrical slot 42 formed in the end face 37 of the input shaft 25. Rotary drive is thus transferred from the input shaft 25 to the output shaft by means of the pin 40. Because of the offset between the axes 31 and 32, which is accommodated by rotation of the pin in the bushing 41 and sliding of the bushing in the slot 42, the output shaft is driven at a cyclically varying angular velocity, each cycle corresponding to one rotation of the output shaft 26. The variation is harmonic and generally sinusoidal. Drive to the turret 10 is taken off the output shaft from a sprocket 43 via a further chain (not shown) and goes through a 12:1 reduction such that the turret rotates once for every 12 revolutions of the output shaft 25. In this way, the cycle of varying angular velocity is repeated twelve times during each revolution of the turret and in particular is repeated for each finger set on the turret as it picks up a can body stripped from the punch.

The degree of variation of the speed of the output shaft can be adjusted by moving the output shaft laterally on its mountings to increase or decrease the offset d between the axes 31 and 32. This offset d will normally remain fixed after an optimum setting has been found.

Figure 7:
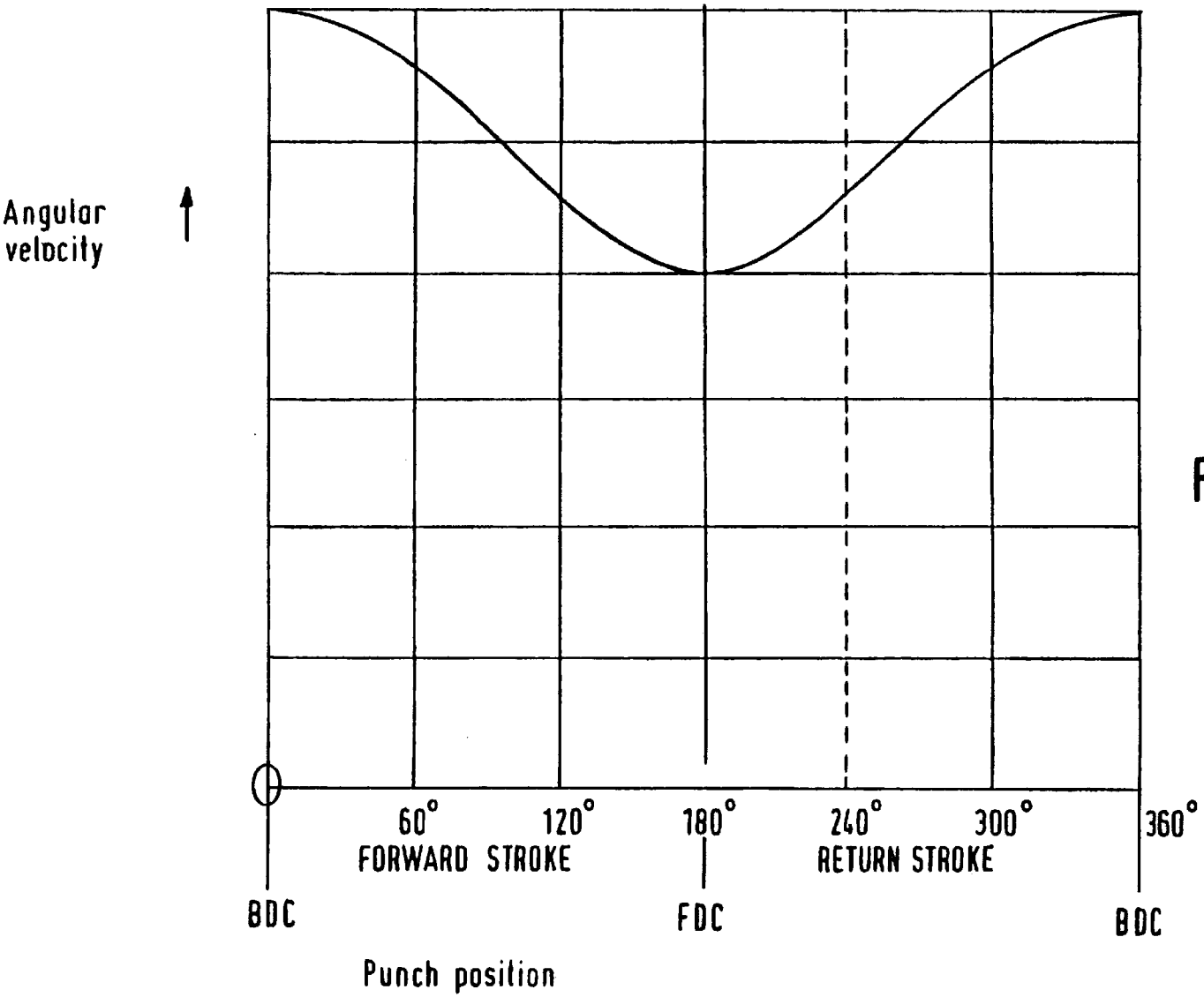
FIG. 7 is a plot showing the angular velocity of the turret in relation to the punch position.

FIG. 7 shows the relationship between the angular velocity of the turret and the position of the punch in a preferred example. As shown, the angular velocity of the turret is greatest when the punch is at the BDC position, that is fully withdrawn, and is least when the punch is at the FDC position, that is fully forward in engagement with the doming tool. The point where the fingers 14 engage the can body is indicated on FIG. 7 by a dotted line and occurs about 60° (of the punch cycle) after the FDC position. At this point, the turret is gathering speed but its angular velocity is less than it is at other times. The punch must be clear of the area, that is it must have passed back through the stripper plates by the time the fingers 14 engage the can. The period when the punch is in this area is 60° either side of the FDC position. Because the turret is moving relatively slowly over this part of the cycle, the time window for the punch is enhanced. In another arrangement, the angular velocity of the turret might be at a minimum at the point where the fingers engage the can body.

Although a preferred embodiment of the invention has been specifically illustrated and described herein, it is to be understood that minor variations may be made in the apparatus without departing from the spirit and scope of the invention, as defined the appended claims.

What is claimed is:

1. Apparatus for making can bodies comprising:

a punch;

means for supporting the punch for reciprocal movement along a punch axis;

a rotary turret;

means for supporting the rotary turret adjacent said punch for rotation about a horizontal axis substantially parallel to the axis of the punch;

a plurality of conveying elements spaced substantially circumferentially around, carried by and extending substantially radially from the turret and being adapted to pick up, support and convey can bodies stripped from the punch as the turret rotates; and drive means for driving the turret in continuous rotation at a cyclically varying angular velocity such that an angular velocity of a conveying element is less at the moment when it engages a can body stripped from the punch than when the punch is in a withdrawn position.

2. The apparatus as defined in claim 1 wherein said drive means drives said turret in repetitive cycles with one cycle being repeated for each conveying element of the turret as each conveying element picks up a can body stripped from said punch.

3. The apparatus as defined in claim 2 wherein said conveying elements each include finger sets, and each finger set is defined by a plurality of fingers which are substantially circumferentially aligned and axially spaced relative to said turret.

4. The apparatus as defined in claim 1 wherein said conveying elements each include finger sets, and each finger set is defined by a plurality of fingers which are circumferentially aligned and axially spaced relative to said turret.

5. The apparatus as defined in claim 4 wherein each finger is formed from rubber and is integral with a finger of an adjacent finger set.

6. The apparatus as defined in claim 1 wherein said drive means includes an input shaft and an output shaft mounted for axial rotation, said input and output shafts having end faces in opposing relationship to each other and axes in parallel but slightly spaced relationship, and a pin extending axially from the end face of one of said input and output shafts which is rotatably and slidably received in a diametrical slot in the end face of another of said input and output shafts.

7. The apparatus as defined in claim 6 wherein said pin is rotatably received in a bushing, and said bushing is slidably received in said diametrical slot.

8. The apparatus as defined in claim 7 wherein said input shaft is driven by said drive means at a constant angular velocity in timed relation to the reciprocal movement of said punch, and said driving means drives said turret through said output shaft through an n:1 reduction wherein n is the number of conveying elements on the turret.

9. The apparatus as defined in claim 6 wherein said input shaft is driven by said drive means at a constant angular velocity in timed relation to the reciprocal movement of said punch, and said driving means drives said turret through said output shaft through an n:1 reduction wherein n is the number of conveying elements on the turret.

10. The apparatus as defined in claim 1 including a doming tool for forming a dome in a bottom wall of each can body, said doming tool being aligned with said punch axis, and said punch axis passes in a space between two adjacent conveying elements on the turret when the punch engages the doming tool.

11. The apparatus as defined in claim 10 including a frame component, a support door pivotally mounted on said frame component for movement between an operative position and an inoperative position, said doming tool being mounted in said support door, said rotary turret being mounted on a cylindrical turret bearing arm, and said turret bearing arm is provided with door locator blocks for locating the support door in its operative position such that the turret is effectively mounted around the door support.

12. The apparatus as defined in claim 1 including a vacuum conveyor adjacent said turret for receiving can bodies carried thereto by said turret.

13. The apparatus as defined in claim 12 wherein at least a part of the vacuum conveyor is pivotally mounted for pivoting movement into an inoperative position in which it affords access to said turret.

14. The apparatus as defined in claim 12 including a receptacle mounted adjacent said turret for receiving can bodies which are not successfully transferred to the vacuum conveyor.

15. The apparatus as defined in claim 1 including an arcuate brush mounted over said turret for holding can bodies in place on the turret as the turret rotates.

16. The apparatus as defined in claim 15 wherein at least a part of the vacuum conveyor is pivotally mounted for pivoting movement into an inoperative position in which it affords access to said turret.

* * * * *